US006634423B2

(12) United States Patent
Giebeler et al.

(10) Patent No.: US 6,634,423 B2
(45) Date of Patent: Oct. 21, 2003

(54) LIFTING TOP DRIVE REMOTE CONTROL CEMENT HEAD

(76) Inventors: Norman B. Giebeler, 1443 S. Gage St., San Bernardino, CA (US) 92408; James F. Giebeler, 1443 S. Gage St., San Bernardino, CA (US) 92408

( * ) Notice: Subject to any disclaimer, the term of this patent is extended or adjusted under 35 U.S.C. 154(b) by 37 days.

(21) Appl. No.: 10/050,804

(22) Filed: Jan. 16, 2002

(65) Prior Publication Data

US 2003/0132002 A1 Jul. 17, 2003

(51) Int. Cl.[7] ..... E21B 23/10

(52) U.S. Cl. ..... 166/70; 166/154; 166/177.4; 166/285; 166/76.1; 166/90.1; 166/92.1; 166/75.14; 166/97.5

(58) Field of Search ..... 166/365, 70, 78.1, 166/153, 154, 177.4, 285, 88.1, 76.1, 90.1, 92.1, 75.14, 97.5

(56) References Cited

U.S. PATENT DOCUMENTS 3,616,850 A * 11/1971 Scott
4,406,485 A 9/1983 Giebeler
4,995,457 A * 2/1991 Baldridge
5,095,988 A * 3/1992 Bode
5,293,933 A * 3/1994 Brisco
5,735,348 A * 4/1998 Hawkins
5,918,673 A * 7/1999 Hawkins et al.
5,950,724 A * 9/1999 Giebeler
6,279,654 B1 * 8/2001 Mosing et al.

* cited by examiner

*Primary Examiner*—Roger Schoeppel

(57) ABSTRACT

A lifting top drive sub sea staging cement head in which cement slurry flows from outside into its central bore, thru a rotating swivel connection. The cement head has a rotatably indexable reservoir cylinder with multiple cells which may be loaded with balls, and/or darts, and/or staging bombs. One first cell is kept open for circulation. The cylinder is rotatably aligned, at will to the flow path, so that the staging elements may be washed down the drill string.

In addition, the cement head is hydraulically remotely controlled such that no operators protrude from the smooth body, yet the remote system may be manually over-ridden.

12 Claims, 9 Drawing Sheets

LIFTING TOP DRIVE REMOTE CONTROL CEMENT HEAD

BACKGROUND OF THE INVENTION

1. The Field of the Invention

The present invention pertains generally to the field of oil well cementing equipment, and more specifically to the cement head apparatus used in a sub sea cementing operation.

2. Description of the Prior Art

Traditionally, in the oil field industry, the rubber darts and/or rubber balls used for a down hole cementing operation are held in a cementing head, up and out of the cement slurry flow path. The rubber darts and/or balls are released at the appropriate time to join into the cement flow moving down the hole.

In many of the early designs, such as in U.S. Pat. No. 3,616,850, the dart simply falls into the flow path, while Bode in U.S. Pat. No. 5,095,988, uses pushers to inject the balls or darts into the flow. In order to guarantee plug passage, a wash-down manifold with two valves is often used with a dart containing cement head to redirect the flow from below to above the dart ensuring that it be washed down the hole.

In his patent U.S. Pat. No. 4,995,457, Baldridge adapts this design with a lift-through type cement head and a heavy-duty swivel to afford drill string lifting and rotation along with the release of a ball and a dart for sub sea cementing.

This system is awkward to handle and it requires that the drill string be rotated from below the swivel through the kelly by the rotary table.

My previous design in U.S. Pat. No. 5,950,724, provided a sub sea cementing head connecting directly below the top drive power drilling swivel, rated at 500 metric tons lifting capacity combined with 10,000 psi internal pressure and 50 rpm rotation speed. In this flow through design, the rubber dart is held in the middle of the slurry flow, protected in a cage. The ball is held within the sidewall. The mechanical ball dropper and dart release pin puller protrude out from the cement head. These devices maybe made remote control hydraulic, but this system is limited when dropping multiple darts or balls.

In sub sea well drilling applications performed by an off-shore drilling platform or specialized drill boat, the pipe lifting system has the ability to lift 750 metric tons or (1,653,450 lbs) of pipe. A cement head combines this load simultaneously with an internal 10,000 psi working pressure and has the ability to rotate at 50 rpm to assure sufficient displacement of the cement flowing around the casing being held below the drill pipe, and further to have flow capacity of up to 60 barrels per minute of cement flow at speeds of up to 50 feet per second.

Now therefore, there is a strong desire for a cement head in which, cement flows into the head from the top, and further has a high tensile strength and the capacity of swivel, and a reservoir for three balls or plugs or darts while maintaining fluid circulation, and further to release the staging elements by remote control.

BRIEF SUMMARY OF THE INVENTION

The present invention is directed to a lifting cement head which is connected directly to the top drive power swivel, such that it carry the extreme high tensile load including the entire drill string. This cement head has the capacity to lift the entire drill string, of up to 750 metric tons or 1,650,000 lbs in combination with 10,000 PSI internal pressure. A further feature of the invention is a fluid swivel allowing drilling fluid or cement slurry to flow directly into the cement head central bore from an outside anchored connection, such that the drill string may be simultaneously rotated at 50 rpm. Accordingly, it is another object of the present invention to hold the rubber elements used in cementing in a multi celled reservoir cylinder, protecting them from the abrasive fluid circulated.

To these ends, a lifting top drive cementing head of the present invention, comprises a complete hydraulic remote control system to unlock, index the multi celled reservoir cylinder, and relock it. This system may also be manually over-ridden, to cycle it from the outside in the event of a hydraulic failure. It is yet a further object of this present invention to provide a mechanical outside position indicator of the rotating reservoir cylinder, and yet to disclose a lever style tattle tale device in the lower sub to indicate the dart passage down hole.

A lifting top drive cement head of the instant invention fulfills all of the above objectives. Further, a cement head of the present invention can be connected directly to the drilling swivel of the very largest offshore oil drilling rigs in the world today.

These and other objects, features, aspects, and advantages of the present invention will become better understood with reference to the following description and accompanying drawings.

DETAILED DESCRIPTION OF THE PRESENT INVENTION

Figure 1:
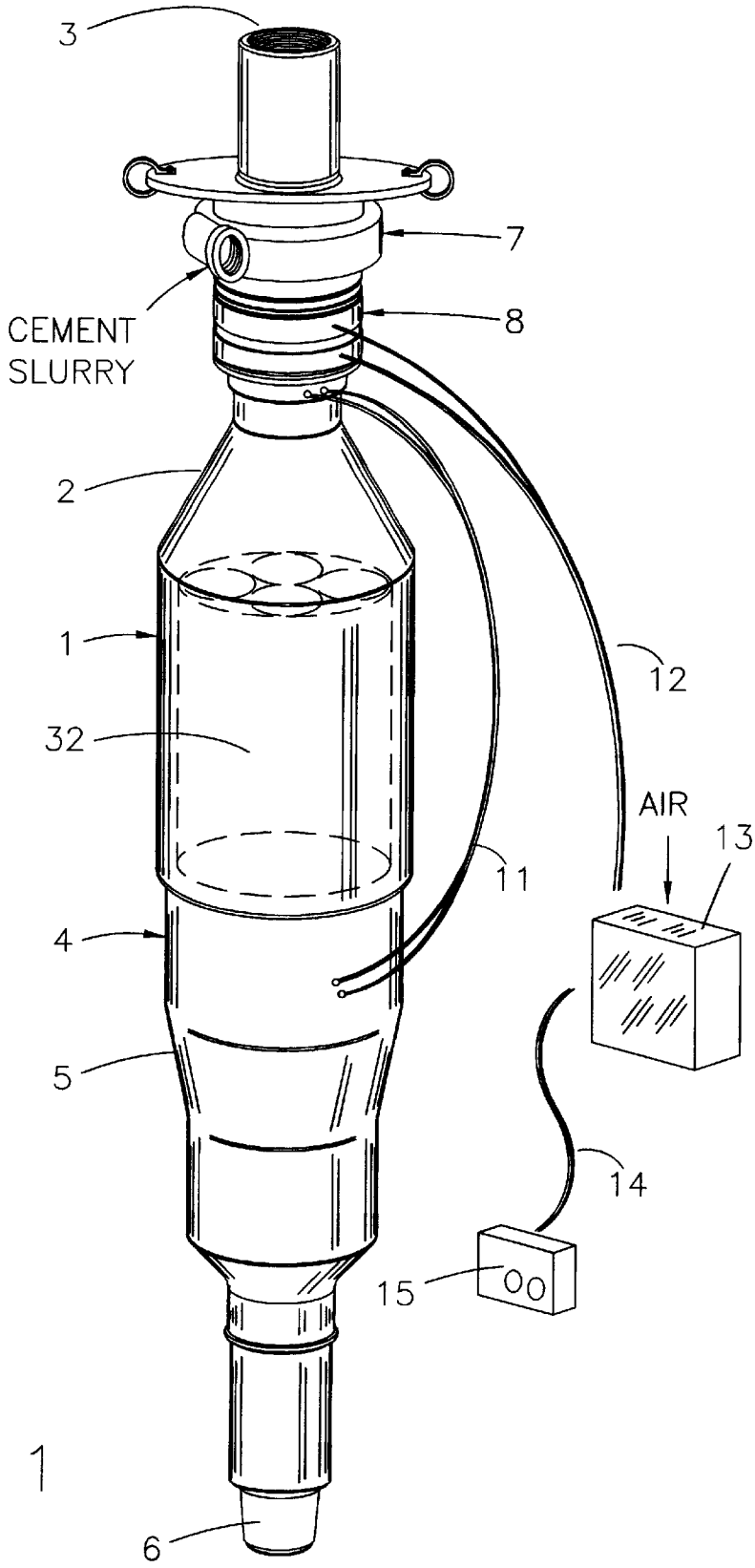
FIG. 1 is a perspective view of the complete cement head system of the present invention.

Referring to the drawings, FIG. 1 shows a complete remote control cement head system, which has the following basic components; an upper body assembly 1 which connects directly to the top drive of the drill rig by top thread 3 and a lower body assembly 4 having threaded end 6 for connection to the drill string, a fluid swivel assembly 7 and a hydraulic control swivel assembly 8, jumper hoses 11 from the rotation mechanism to the swivel, main hydraulic hoses 12, a pump reservoir 13, and a hand control 15 connected by hoses 14.

Figure 2:
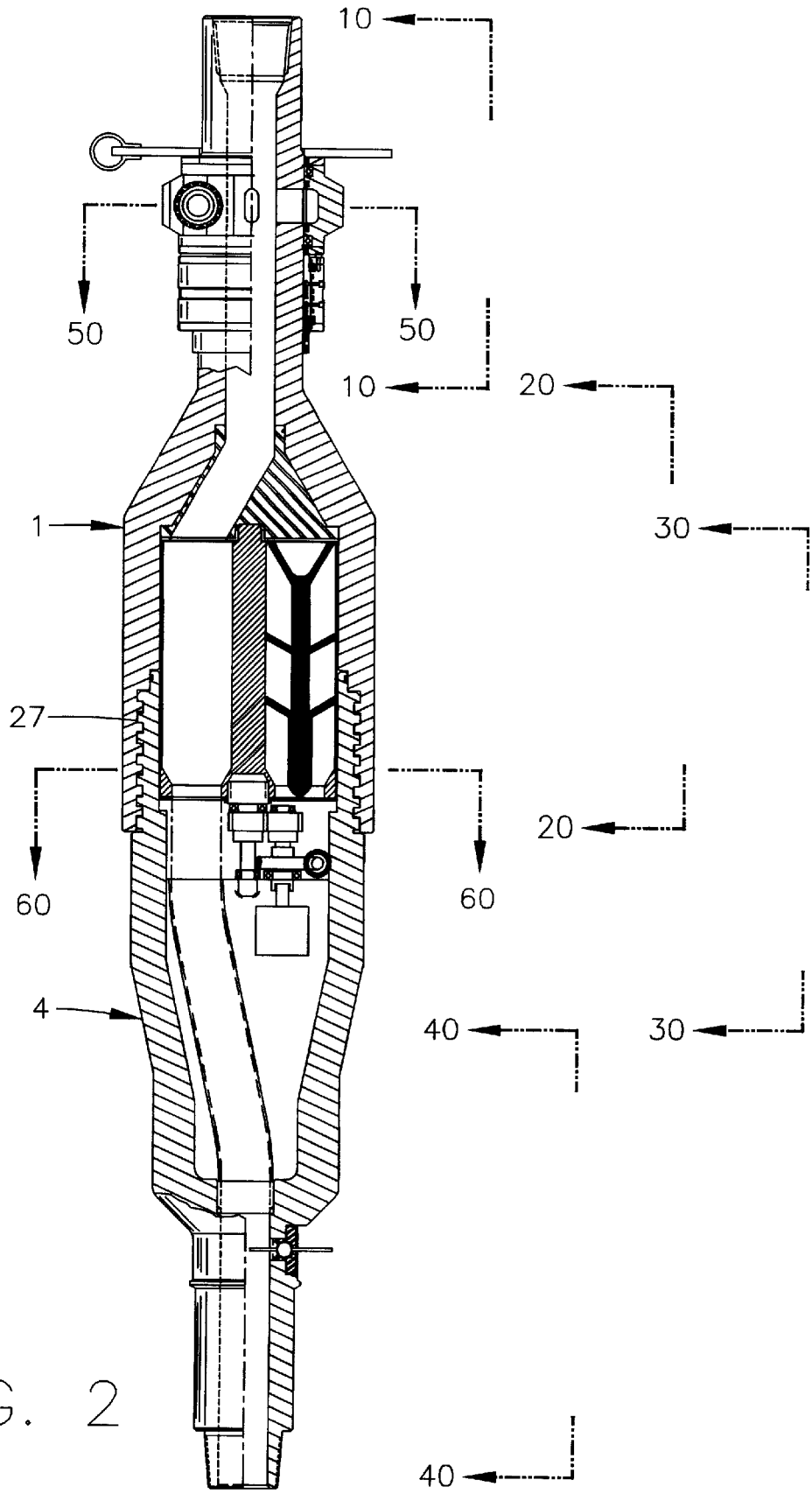
FIG. 2 is an elevational sectional view of the cement head of the present invention.

FIG. 2 is an elevational sectional assembly of the entire cement head including the upper body assembly 1 and lower body assembly 4, with section line indicators.

Figure 3:
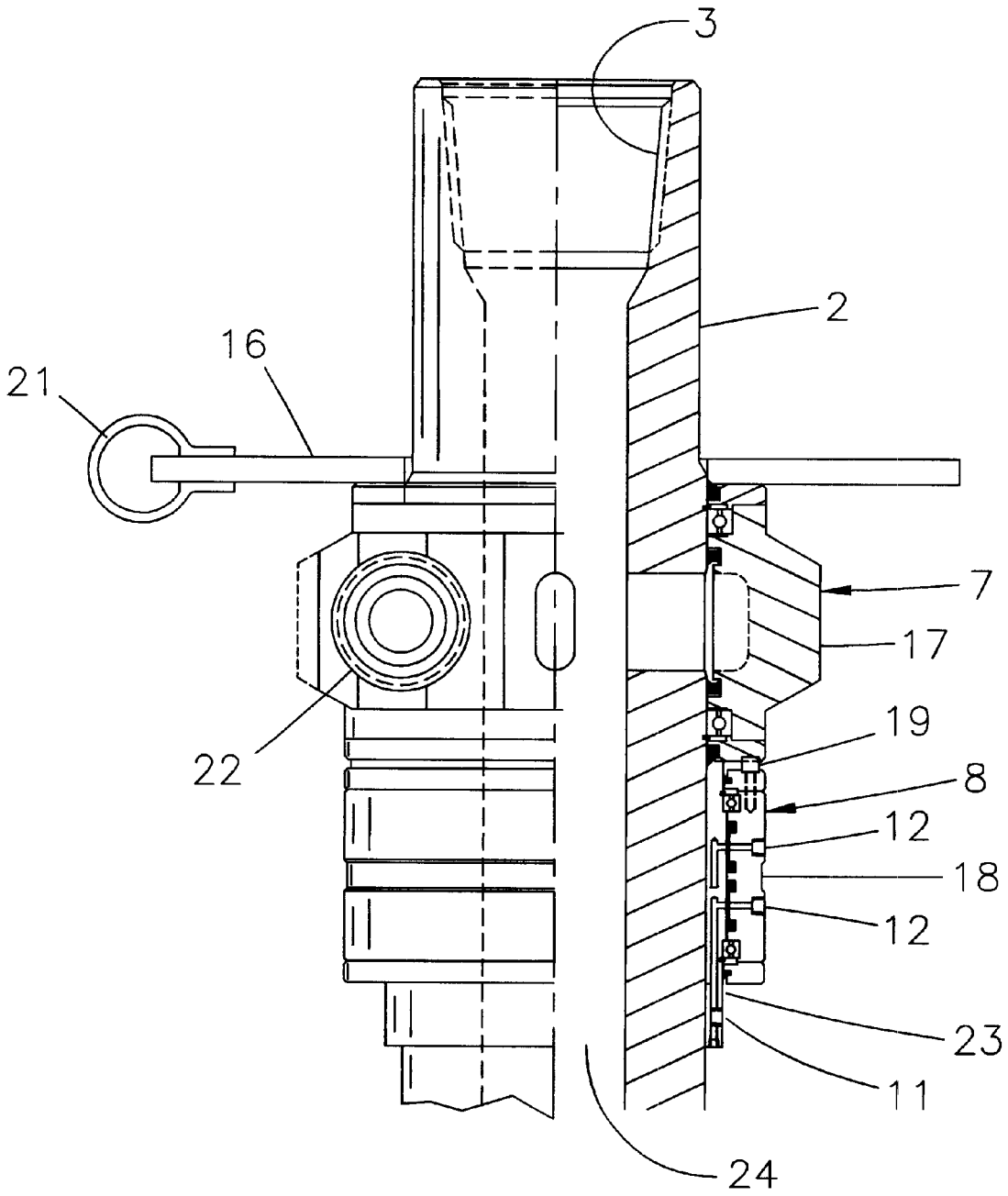
FIG. 3 is an enlarged elevational sectional view taken on line 10—10 of FIG. 2.

In more detail, FIG. 3 shows the fluid swivel assembly 7 which is integral with the upper body 2. Restraint arm 16 is attached to fluid swivel body 17 which also drives the swivel body 18 of hydraulic swivel assembly 8 thru drive bolts 19. Shackle ring 21 on restraint arm 16 is fixedly chained to the top drive of the drill rig to hold stationery swivel bodies and the main hydraulic hoses 12 connecting to swivel body 18 and the cement slurry hoses connecting to fluid subs 22 on body 17, while the entire cement head assembly and the drill string is rotated. Jumper hoses 11 from the rotation mechanism connect to the tubular mandrel 23 which is fixed to upper body 2.

Figure 7:
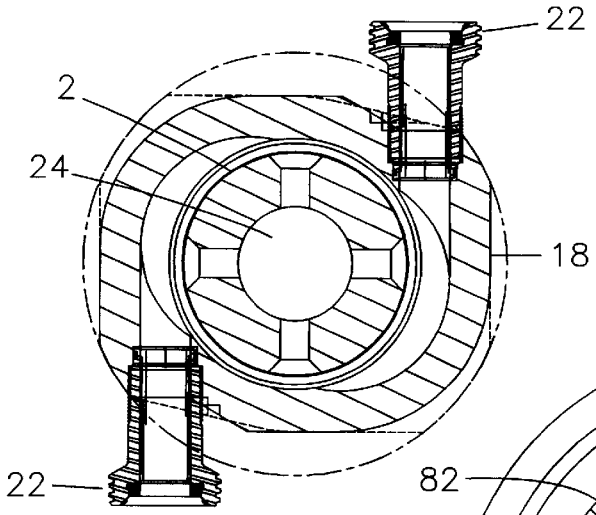
FIG. 7 is an enlarged sectional view of the fluid swivel taken on line 50—50 of FIG. 2.

FIG. 7 shows the flow path of cement slurry through fluid subs 22 on swivel body 18 into the central bore 24 of upper body 2.

Figure 4:
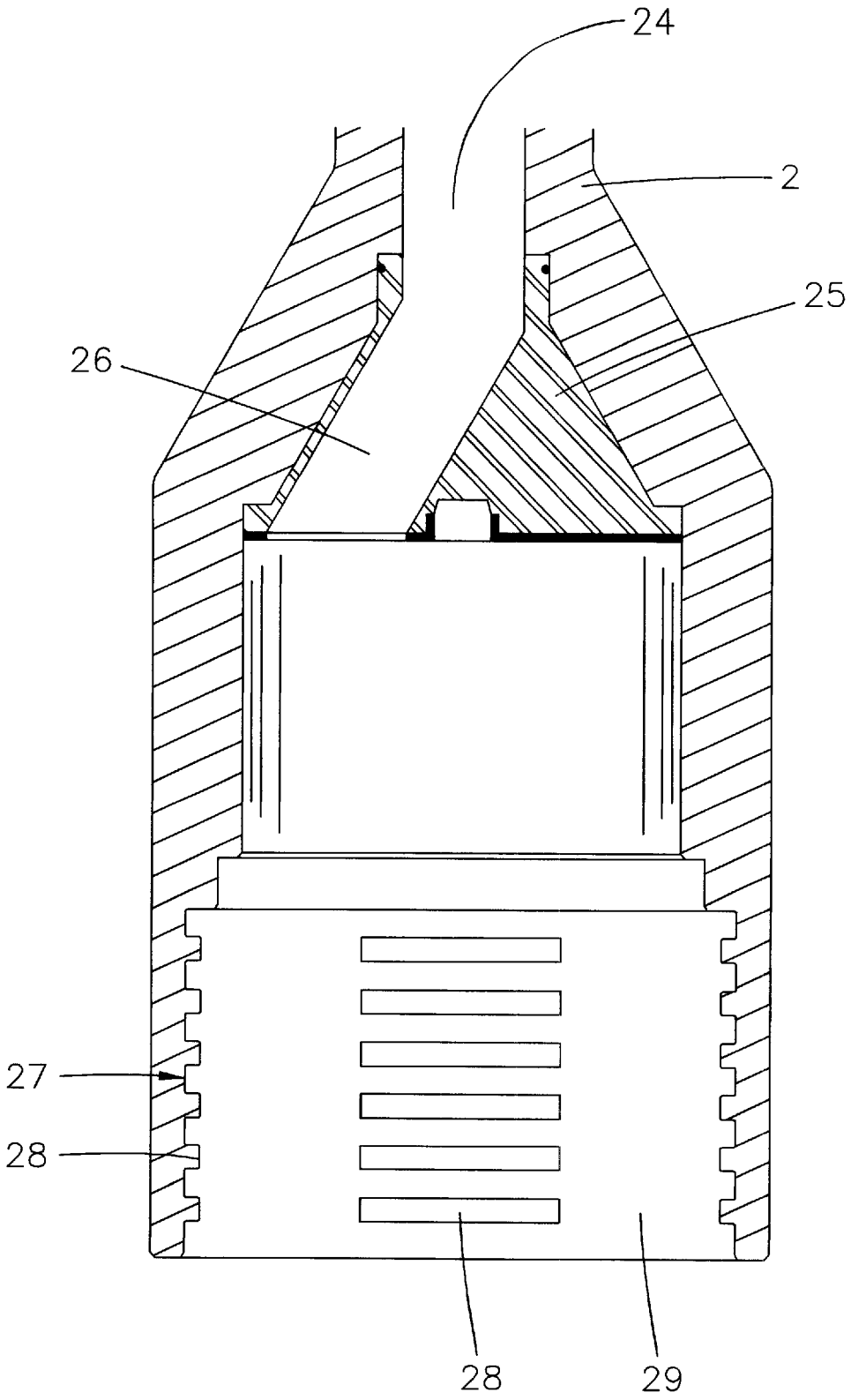
FIG. 4 is an enlarged elevational sectional view taken on line 20—20 of FIG. 2, disconnecting the tool at it's sure lock connection.
Figure 9:
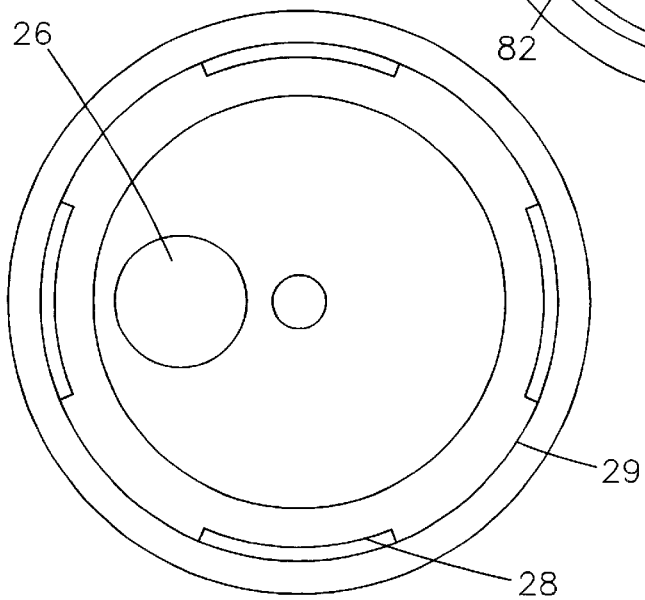
FIG. 9 is an end view of FIG. 4.

As shown in FIG. 4 the central bore 24 continues to the upper flow diverter 25 where it is diverted to the offset bore 26. This offset bore 26 is clearly seen in the end view of FIG. 9. The cement head is separated by its sure lock connection 27 with its upper lugs 28 and slots 29.

Figure 5:
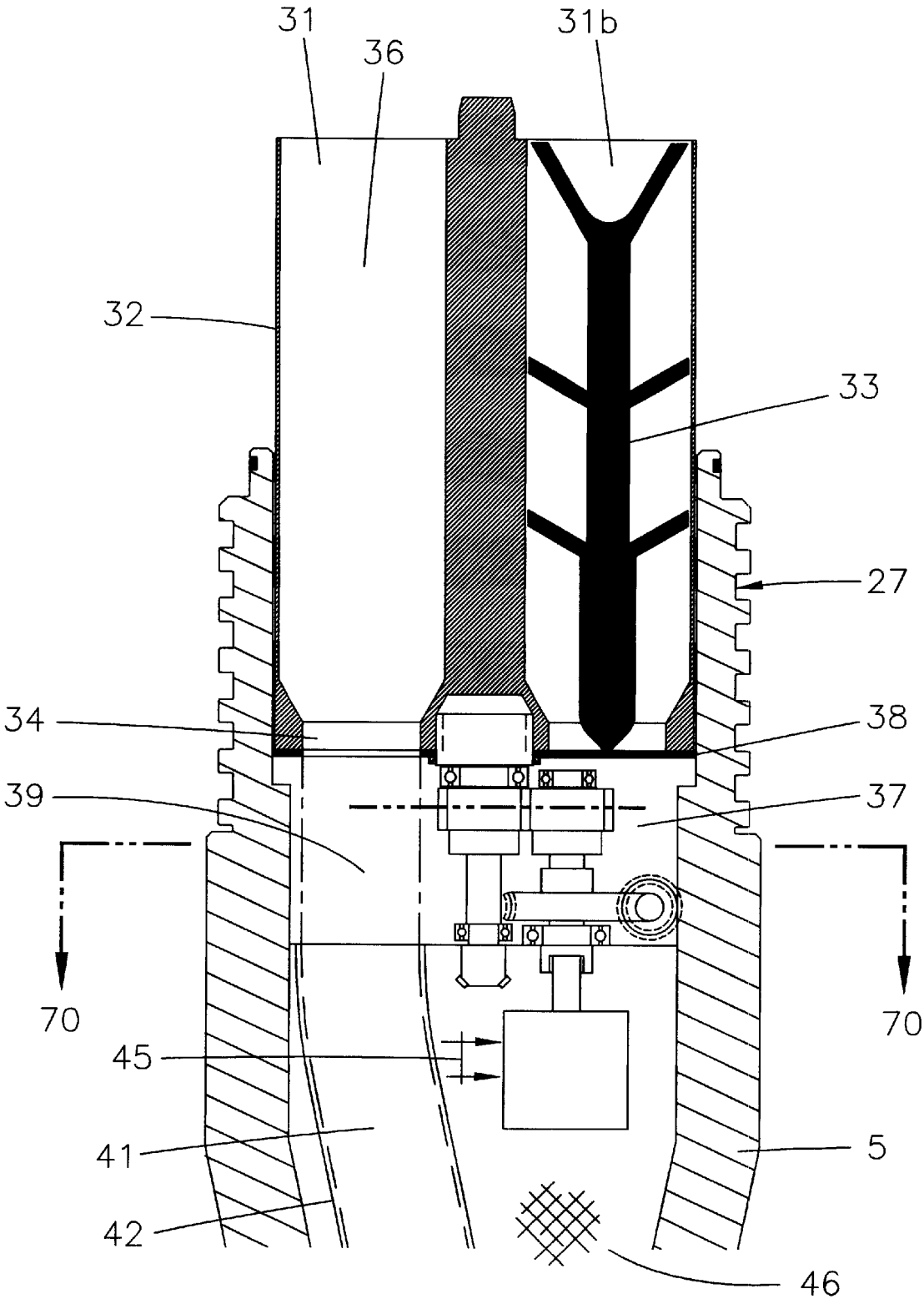
FIG. 5 is an enlarged elevational sectional view taken on line 30—30 of FIG. 2, the tool disconnected at the sure lock connection, including the rotating cylinder.
Figure 8:
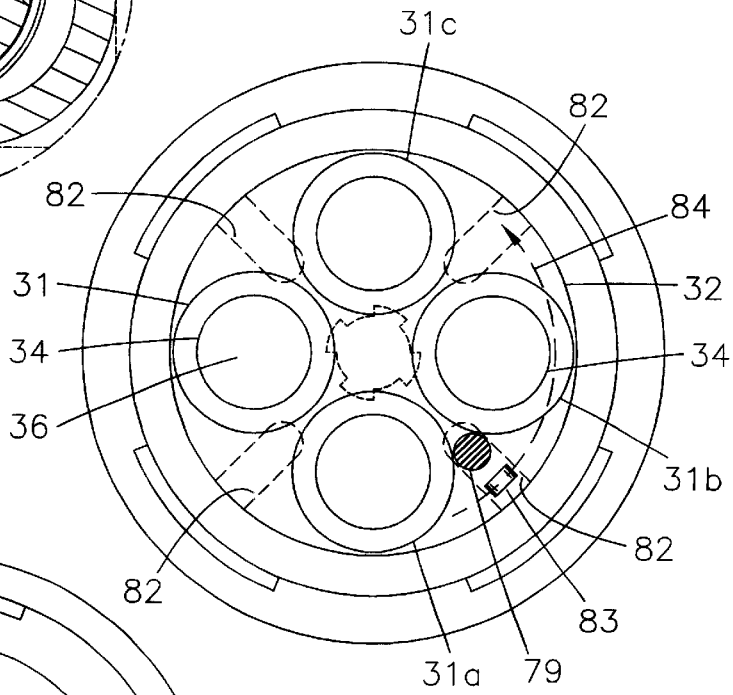
FIG. 8 is an enlarged sectional view showing the rotating reservoir cylinder taken on line 60—60 of FIG. 2.*e*

Now, FIG. 5 continues with the upper portion of the lower body 5 separated at the sure lock 27 for service and loading of balls and/or darts into the open cells 31 of the rotating reservoir cylinder 32. The upper bore portion of cell 31 is of larger diameter to facilitate the loading of an uncompressed rubber dart 33, as shown in cell 31*b*. The section, FIG. 8 shows these 4 cells. In order for the dart to pass down hole it must pass through a converging neck 34 to match all of the following bores which are equal to that of the bottom sub 35 and the subsequent drill string. The home position cell 36 is always left open to preserve initial unrestricted circulation. The mounting plate 37 with its teflon washer 38 provide the floor to cylinder 32. The through hole 39 in plate 37 and washer 38 align with the bore 41 of flexible hose 42 which connects to plate 37 and then to the inside of bottom sub 5 at 43 so to connect with its bore 35.

Figure 6:
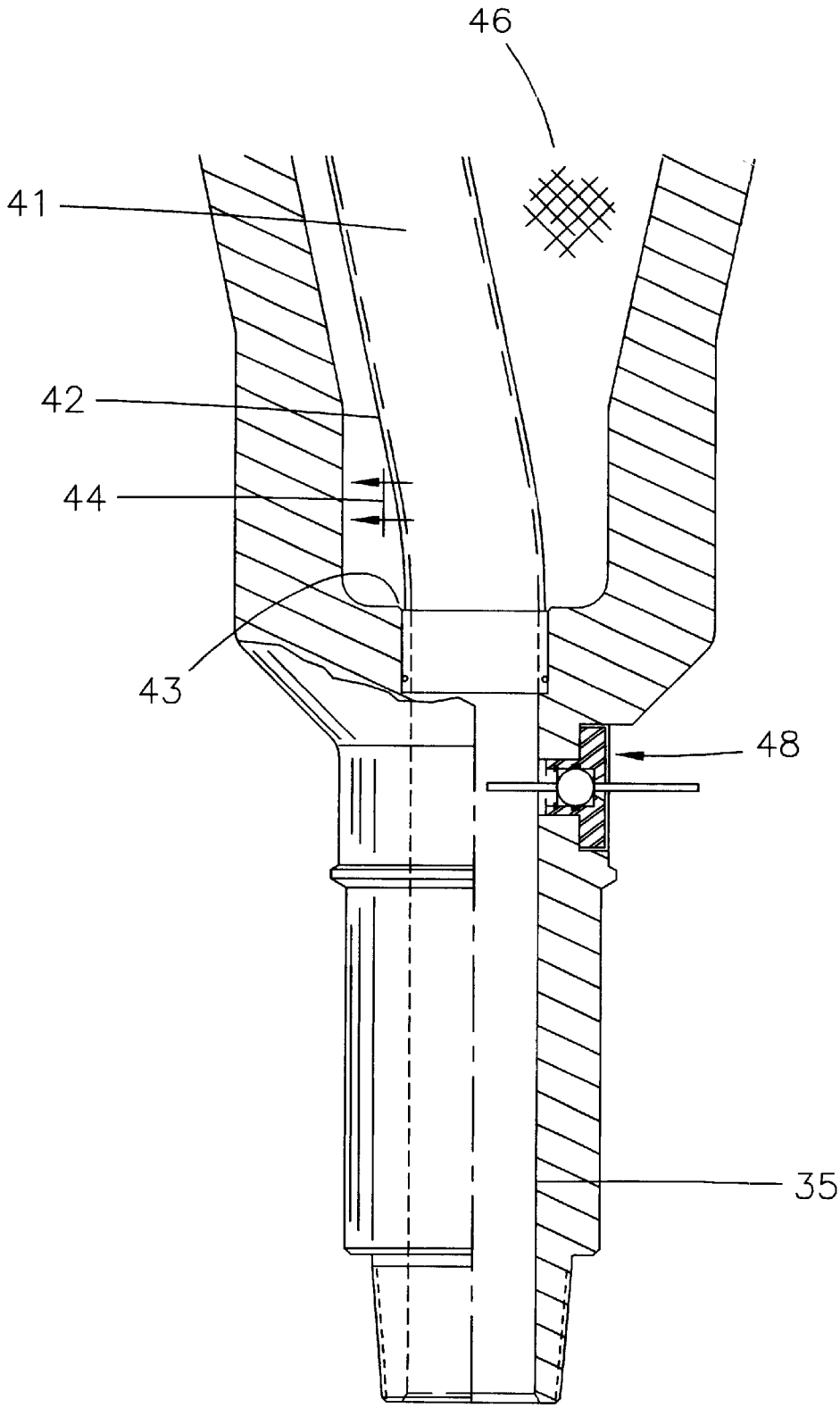
FIG. 6 is an enlarged elevational sectional view taken on line 40—40 of FIG. 2.

As the hose 42 is free to move, combining FIG. 5 and FIG. 6 shows the undulation of hose 42 as a long dart 33 passes through its bore 41, moving first left at 44 then right at 45. The entire inside of lower body 5 is filled with liquid jell 46 such that hose 42 is perpetually free to move without fear of cement slurry encroachment, because diaphragm 47 shown in FIG. 10, in mounting plate 37, maintains a same pressure inside the lower body 5 as in the cement slurry area. Back to FIG. 6, the passage of the dart 33 from hose 42 into the bottom sub bore 35 is indicated on the outside by the tattle-tale assembly 48, where downward movement of the inside lever translates to the outside indicator lever.

Figure 12:
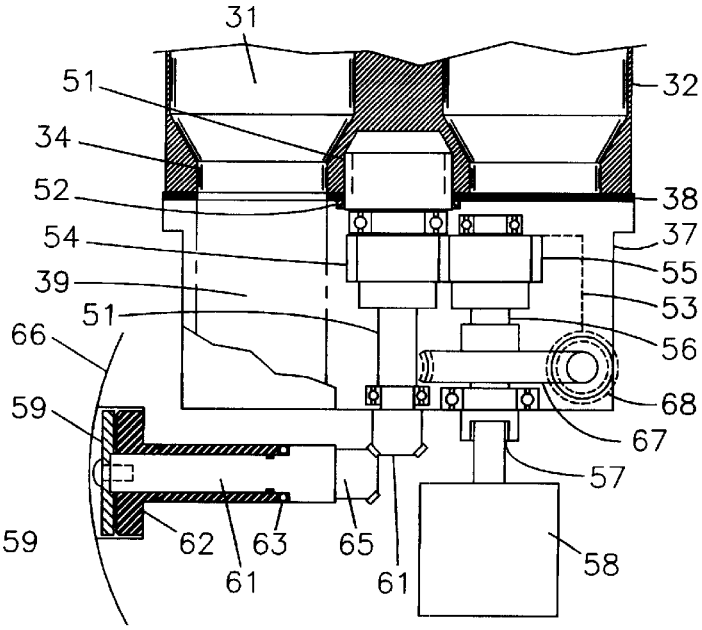
FIG. 12 is a sectional view of the remote control drive with the external reading position indicator of the reservoir cylinder taken on line 90—90 of FIG. 10.

Now in FIG. 12, the enlarged elevational section, cylinder 32 is driven through spline 49 by splined shaft 51 which has lip seal 52 to exclude cement slurry from the gearbox 53 in mounting plate 37. Splined shaft 51 is appropriately bearinged in plate 37 with spur gear 54 and driven by spur gear 55 from bearinged spud shaft 56 which is in turn driven through one-way clutch 57 by hydraulic vane operator 58.

Figure 13:
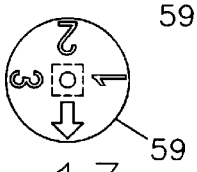
FIG. 13 is a front view of the position indicator dial of FIG. 12.

FIG. 13 shows another novel feature of the cement head of this present invention which is the external reading tattle tale indicator dial 59 which shows the exact position of the rotating reservoir cylinder 32. Now, turning back to FIG. 12, the dial 59 is mounted to dial shaft 61 which is carried by gland 62 with thrust bearing 63 to absorb differential pressure thrust on the shaft. The dial shaft 61 is driven directly from splined shaft 51 by 1-to-1 miter gears 64 and 65. Line 66 depicts the outside diameter of the lower body 5.

Figure 10:
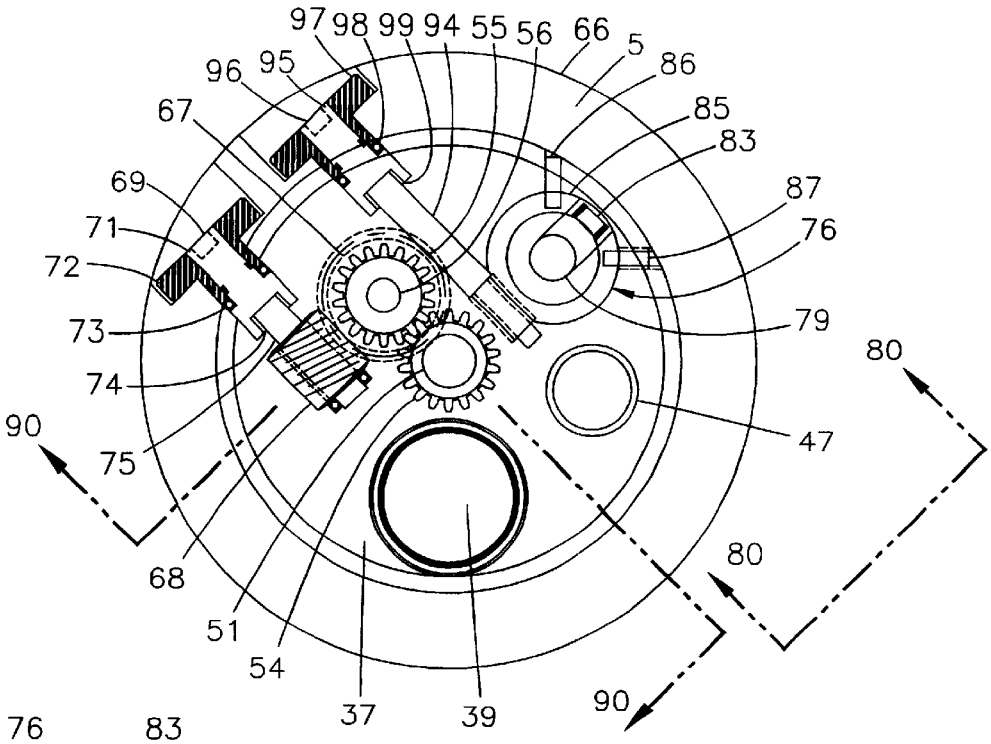
FIG. 10 is an enlarged sectional view of the remote control drive system with manual override taken on line 70—70 of FIG. 5.

FIG. 10 is a sectional view showing the manual override operating system from outside of the cement head, shown by diameter 66. Square socket 69 in rotate shaft 71 carried in gland 72 with thrust bearing 73 drives the worm shaft 75 through one-way clutch 74 to operate the quad-lead worm 68 which engages worm gear 69 on spud shaft 56 which through successive engagements rotate cylinder 32.

Figure 11:
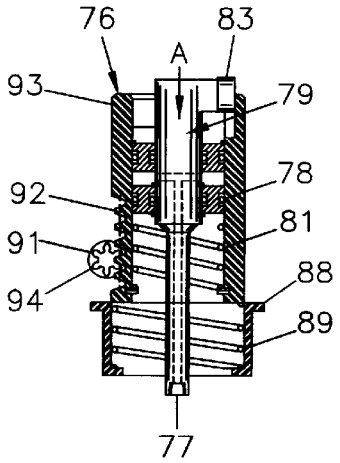
FIG. 11 is an elevational sectional view of the locking cylinder taken on line 80—80 of FIG. 10.

Yet another novel feature of this application is shown in FIG. 11, an elevational section of the double lock assembly 76 which operates both hydraulically or manually to lock and unlock cylinder 32 for rotation. The lock assembly 76 functions hydraulically to unlock as oil pressure enters the piston rod 79 at thread 77, and then pushes piston 78 and rod 79 down, as at A. When the system is deactivated, spring 81 returns piston and rod 79 to lock position in slot 82 in the bottom of cylinder 32, shown in FIG. 8.

FIG. 8 is a section of the cement head showing the preferred embodiment, with four cells 31 and four slots 80. Roller 83 is affixed to rod 79 and rolls around the perimeter of cylinder 32 at radius 84, preventing rod 79 from errantly locking in a bore 34, instead of the next slot 82.

Now turning back to FIG. 10 and FIG. 11, lock assembly 76 slides in bore 85 in mounting plate 37 guided by key 86 and held by retainer screw 87. Spring cup 88 and spring 89 push the lock assembly 76 up, to lock the cylinder 32 from rotation. Pinion gear 91 engages rack gear 92 in the side of cylinder 93 to manually override an inoperative hydraulic system by moving down the entire lock assembly 76, pushing against spring 89. Again, from outside the cement head diameter 66, this system is manually unlocked as the square socket 95 in unlock shaft 96 carried in gland 97 with thrust bearing 98 is turned to drive the pinion shaft 94 through one-way clutch 99, and thus unlocking cylinder 32 for rotation.

Figure 14:
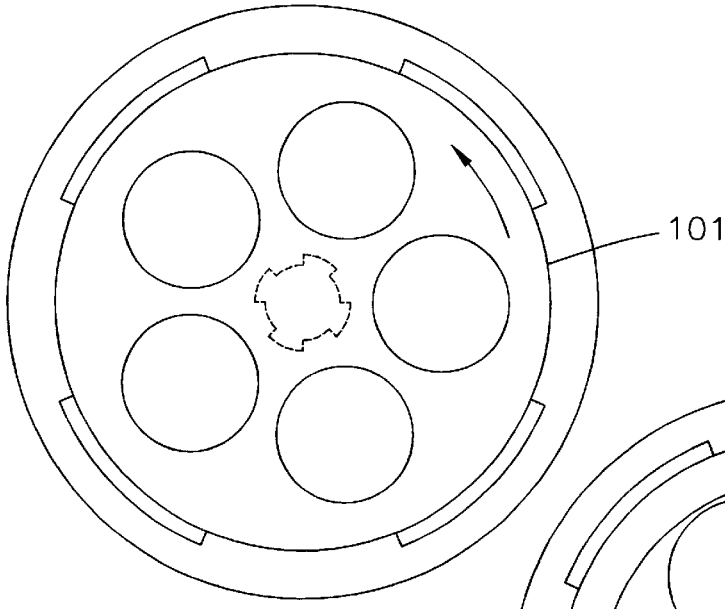
FIG. 14 is an alternate reservoir cylinder with 5 cells.

FIG. 14 depicts a five cell layout 101, alternate to cylinder 32 for additional capacity.

Figure 15:
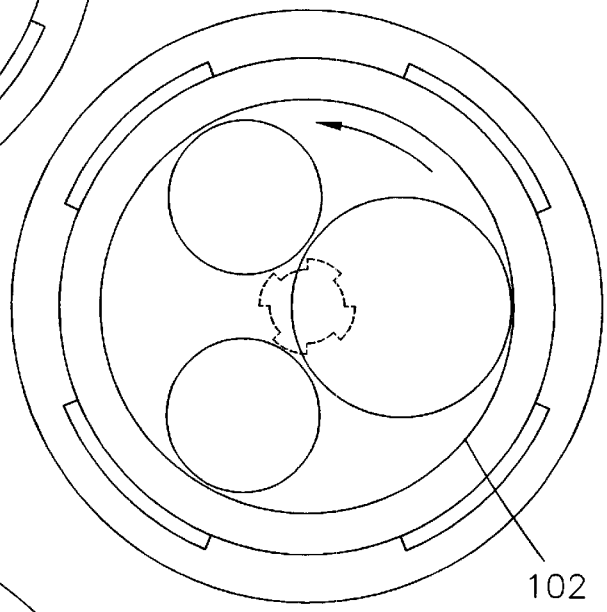
FIG. 15 is an alternate reservoir cylinder with 3 cells.

FIG. 15 depicts yet another alternate cell layout 102, having a three cell cylinder with one extra large cell.

Figure 16:
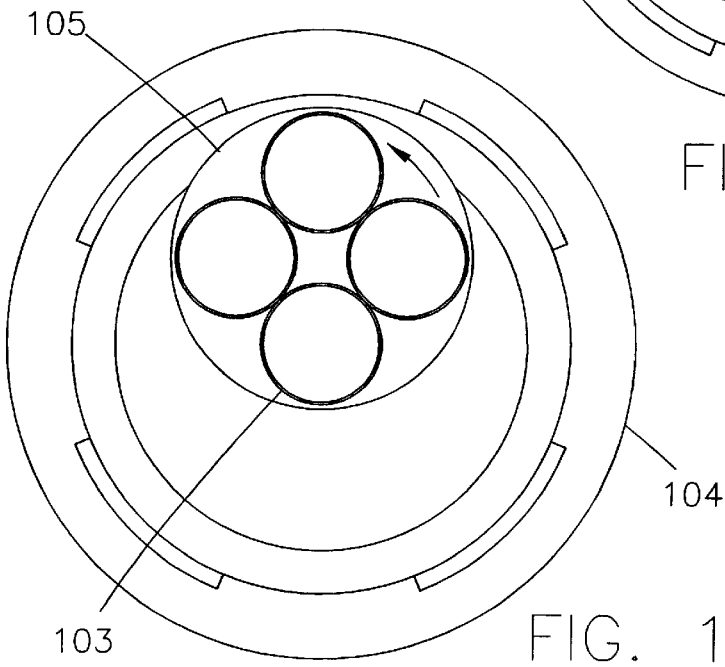
FIG. 16 is a sectional view alternate to FIG. 8.

FIG. 16 depicts yet another alternate cement head arrangement with cell 103 centered in body 104 while rotating cylinder 105 is mounted off center.

Although a preferred embodiment has been shown and described, it will be apparent to those skilled in the art that many changes and modifications may be made without departing from the spirit and scope of the present invention.

What is claimed is:

1. A cement head for lifting a sub sea drill string comprising:

an upper body having a bore for fluid flow extending to a sure lock connection, with an external swivel having connections for fluid flow into a central bore, and a second swivel for control hydraulics;

a cylinder rotatably mounted within a cement head body with multiple cells for balls, darts, and/or staging bombs; and a lower body having a through bore for fluid flow to the drill string, the cement head body holding said cylinder and an indexing and locking mechanism, connected by sure lock to the upper body.

2. The cementing head of claim 1, wherein said external swivel further has a restraint arm with shackle rings, which when chained fixedly prevent said external swivel slurry input connections from fowling when the lifting cement head is rotated.

3. The cementing head of claim 1, wherein said multi celled cylinder is centrally mounted within said cement head body between flow diverters which direct the flow from the head's central bore to a radially offset cell bore.

4. The cementing head of claim 1, wherein said multi celled cylinder is alternately rotatably mounted off center such that one cell is coaxial to the central bore of an upper sub and a lower sub.

5. A flow through cement head with a coaxial multi celled cylinder rotatably mounted between upper and lower flow diverters which allow a cement slurry flow from down through a central bore to connect with a radially offset cell bore in the cylinder and then return likewise back to the central bore.

6. The cementing head of claim 5, wherein the lower flow diverter uses a flexible hose allowing it to undulate as a long dart passes through it, between the radially offset cell bore and a central connection in a bottom sub.

7. A flow through cement head with a flexible hose internally connecting offset bores, wherein said hose is externally pressure compensated by a liquid jell, preventing its entrapment by leaking cement slurry.

8. A remote control wash down flow through lifting cement head fully contained within a cement head body diameter, wherein the cement head contains an indexable multi celled reservoir cylinder for balls and/or darts and/or staging bombs.

9. A flow through cement head having an offset flow path to a coaxial revolving reservoir cylinder for staging elements and an offset flow path to a bottom sub connection.

10. The cementing head of claim 9, wherein the revolving cylinder drives an external reading tattle tale indicator of said cylinder's position, through a one-to-one bevel gear set.

11. The cementing head of claim 9, wherein said rotating cylinder is hydraulically unlocked, and hydraulically indexed, but relocked automatically in position by a spring loaded plunger, wherein said spring loaded plunger lock system maybe manually over-ridden to unlock from the outside of said cement head, further said cylinder maybe manually indexed from the outside.

12. A cement head containing a multi celled plug reservoir cylinder which is rotatably mounted off center such that one cell is coaxial to the bore of a lower sub.

* * * * *